United States Patent [19]

Clements

[11] 4,106,576

[45] Aug. 15, 1978

[54] SAMPLING TUBE CLEANING DEVICE

[76] Inventor: James M. Clements, R.R. #1, Box 162A, Newton, Iowa 50208

[21] Appl. No.: 838,576

[22] Filed: Oct. 3, 1977

Related U.S. Application Data

[62] Division of Ser. No. 670,977, Mar. 26, 1976.

[51] Int. Cl.[2] ..... G01N 1/00

[52] U.S. Cl. ..... 175/313; 73/425.2; 175/316

[58] Field of Search ..... 175/313, 316, 226, 227, 175/84; 294/50, 50.5; 184/102; 73/425.2; 15/104.05, 104.04

[56] References Cited

U.S. PATENT DOCUMENTS

| | | | |
|---|---|---|---|
| 2,559,376 | 7/1951 | Schnitger | 15/104.05 |
| 2,850,754 | 9/1958 | Davis | 15/104.04 |
| 3,324,958 | 6/1967 | Clark | 175/313 |
| 3,817,337 | 6/1974 | Panak et al. | 175/313 |

*Primary Examiner*—Ernest R. Purser
*Assistant Examiner*—William F. Pate, III
*Attorney, Agent, or Firm*—Zarley, McKee, Thomte, Voorhees & Sease

[57] ABSTRACT

A sampling tube cleaning device adapted for removable mounting on a soil sample core extraction tool, the tube cleaning device including a handle portion and a cleaning head connected to the handle portion, the cleaning head further comprising a first cleaning member arranged for being pulled along the length of the trough of a sampling tube, and a second cleaning member arranged for removing the end core from a sampling tube and in a preferred emobodiment the cleaning head also has a U-shaped part provided with absorbent material for applying a thin film of lubricant to the trough of the sampling tube as well as the outside of the sampling tube to provide both a lubricant and cleaning function to the sampling tube to facilitate ease of operation in subsequent uses.

6 Claims, 9 Drawing Figures

SAMPLING TUBE CLEANING DEVICE

BACKGROUND OF THE INVENTION

1. Field of the Invention

This invention relates generally to a soil sampling tool, and particularly to a hand operated soil sample core extraction tool such as used by farmers to take samples of soil in order to determine the composition of the soil.

2. Description of the Prior Art

Many serious back injuries have resulted from "pulling" a soil probe. With a conventional probe handle and rod combination the handle becomes closer to the ground with each successive section of the core that is pulled. The force required to pull the core can be more than 300 pounds, with the average being about 80 to 90 pounds. Man can most safely produce the greatest lifting force in the final 15° of leg extension.

A soil sampling tube fitted with a conventional rod and handle is forced into the ground by pushing downward on the handle. Shoulder, wrist, and arm injuries can result particularly when working with hard ground conditions.

U.S. Pat. No. 2,891,812, issued June 23, 1959 to L. W. Gourley, sets forth a soil sampling device provided with a section of pipe having affixed thereto a handle, a probe, and a footstep disposed for facilitating insertion of the probe into soil being sampled. A second pipe is slidably disposed on the first pipe and is provided with a lower section which facilitates removal of a sample from the probe. Insertion of the lower section is carried out by use of a second footstep attached to the second pipe. The device disclosed in U.S. Pat. No. 2,891,812, however, is directed to the problems of driving a sampling probe a short distance into hard ground and obtaining accurate core samples, and fails to approach the problem of eliminating the long arm and leg extensions encountered when "pulling" a conventional soil probe.

I am aware of the following patents that may be pertinent to the invention:

| | | |
|---|---|---|
| 684,010 | A. Thalheimer | Oct. 8, 1901 |
| 1,548,865 | G. F. Bull | Aug. 11, 1925 |
| 2,531,297 | J. J. Rose | Nov. 21, 1950 |
| 2,957,722 | D. Ferraro | Oct. 25, 1960 |

SUMMARY OF THE INVENTION

It is an object of the present invention to provide a soil sample core extraction tool which eliminates bending over to "pull" the core out of the ground.

It is another object of the present invention to provide a footoperated soil probe wherein the distance from the handgrip of the probe to the footstep thereof is constant and is such that full body weight can be safely applied to the footstep.

It is yet another object of the present invention to provide a soil sample core extraction tool provided with a special cleaning device which facilitates extraction of a sample from the tool and subsequent washing and lubricating of the probe in order to facilitate reinsertion of the tool into soil to be sampled.

These and other objects are achieved according to the present invention by providing a soil sample core extraction tool having: a handle member; a soil probe member movably mounted on the handle member; and a clutch disposed for selectively preventing movement of the soil probe member with respect to the handle member and realize, by sequential actuation and release of the clutch, movement of the handle member relative to the probe member in order to permit the operator of the tool to manipulate the handle member from a convenient position during the entire sampling operation.

The clutch is preferably mounted on the handle member and includes a pressure element mounted for rocking movement relative to the shaft of the soil probe member and provided with a through hole receiving the shaft. According to an advantageous feature of the present invention, the diameter of the hole provided in the pressure element decreases from opposed surfaces of the pressure element to a throat substantially midway between the surfaces in order to form a pair of oppositely directed, substantially coaxial frustoconical shaft-engaging surfaces joining at a transition zone and grippingly engaging the shaft whenever the pressure element is rocked to soil probe push-and-pull modes wherein a portion of each shaft-engaging surface contacts the shaft. Accordingly, the clutch is in neutral mode whenever the shaft-engaging surfaces of the pressure element contact the shaft substantially only at the transition zone joining the shaft-engaging surfaces to one another.

An extension is advantageously provided on the pressure element so as to form a footstep facilitating positioning of the pressure element during neutral and push modes. Further, a resilient element can be disposed between the handle member and the pressure element for biasing the pressure element toward its pull mode.

The soil probe member is generally provided with a sampling tube for obtaining the soil sample being sought. A cleaner according to the present invention is removably mounted on the handle member, and includes a handle and a cleaning head connected to the handle, with the cleaning head comprising a first disc-shaped part arranged for being pulled along the length of a sample receiving trough provided in the sampling tube, a second disc-shaped part for removing the end core form an end bore of the sampling tube, and a U-shaped part provided with absorbent material for applying a thin film of lubricant to the trough with a leg of the U-shaped part and to the outside of the sampling tube with the bight portion of the U-shaped part of the cleaning head. In this manner, the core sample can be efficiently extracted from the sampling tube, and the tube quickly cleaned and lubricated even in the field, for further sample taking.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIGS. 4 through 9 are schematic diagrams showing the various steps in obtaining core samples with an extraction tool according to the present invention.

DESCRIPTION OF THE PREFERRED EMBODIMENTS

Figure 1:
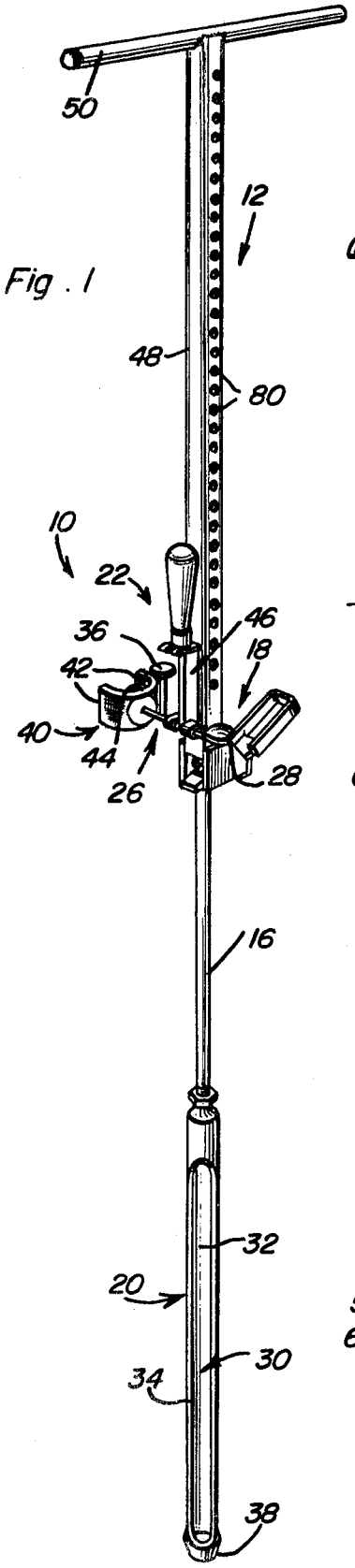
FIG. 1 is a perspective view showing a soil sample core extraction tool according to the present invention.

Referring now more particularly to FIG. 1 of the drawings, a soil sample core extraction tool 10 according to the present invention comprises a handle member 12 and a soil probe member 14 movably mounted on handle member 12. More specifically, soil probe member 14 includes a shaft 16 slidably disposed in a longitudinal socket provided in handle member 12. Also illustrated as mounted on handle member 12 is a clutch 18 arranged for selectively engaging and releasing shaft 16 of member 14 and preventing movement of member 14 with respect to the handle member 12. Removably attached in a conventional manner, as by the illustrated screw threads (FIG. 2), to the lower end of shaft 16 is a substantially cylindrical sampling tube of one configuration which may be employed with a tool according to the present invention.

Removably mounted on handle member 12 is a sampling tube cleaner 22 which includes a handle 24 and a cleaning head 26 connected to handle 24. Head 26 comprises a first disc-shaped part 28 arranged for being pulled along the length of a trough 30 formed in sampling tube 20 by a hollow, cylindrical interior 32 and a longitudinally extending opening 34 communicating with the interior 32. A second disc-shaped part 36 is also provided in head 26 for removing the end core of the sample taken from the open end 38 of tube 20, while a U-shaped part 40 provided with absorbent material such as a sponge rubber or gauze padding, facilitates the application thereto of a thin film of lubricant. More specifically, the lubricant is provided to trough 30 as by a leg 42 of part 40, while the outside of tube 20 receives lubricant from the bight 44 of part 40.

A substantially C-shaped clip 46 is affixed to handle member 12 and provided with forked leg portions in order to receive the handle 24 of cleaner 22 and removably mount cleaner 22 on member 12 for storage and caring purposes when cleaner 22 is not being used.

Handle member 12 includes a longitudinal element 48 having affixed thereto at one end thereof a crossbar 50 forming a T-shaped handle member. The clutch 18 can be seen from FIG. 1 to be mounted at the other of the ends of longitudinal element 48.

Figure 2:
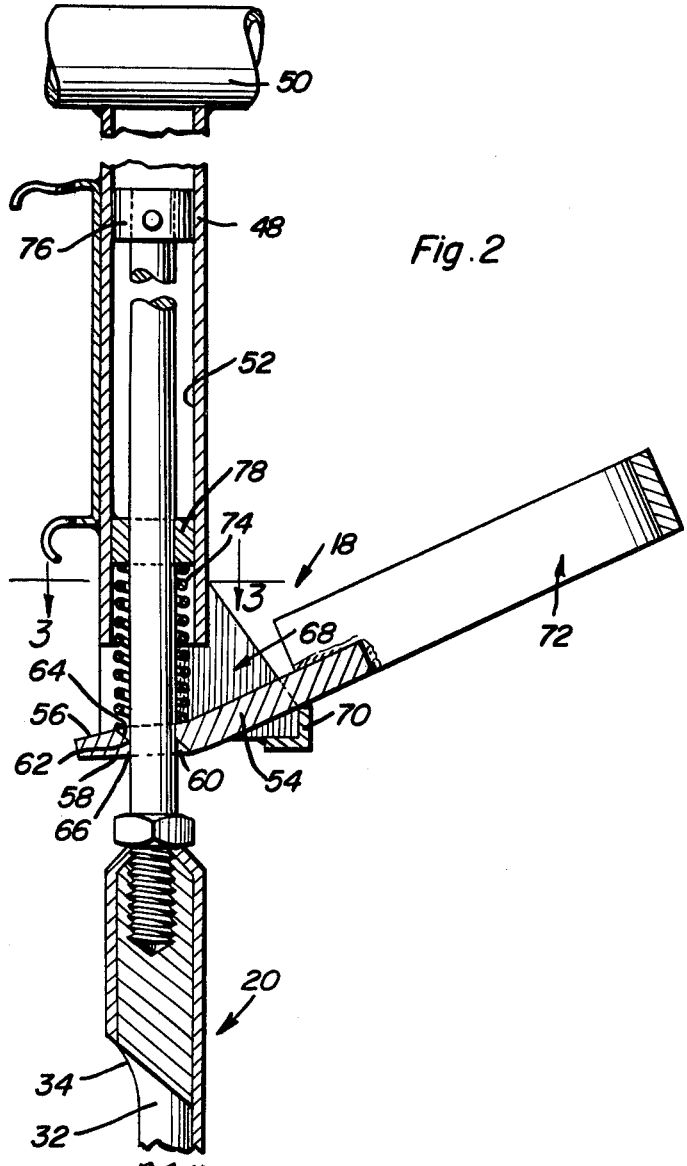
FIG. 2 is an enlarged, fragmentary, vertical longitudinal sectional view showing details of the tool of FIG. 1.
Figure 3:
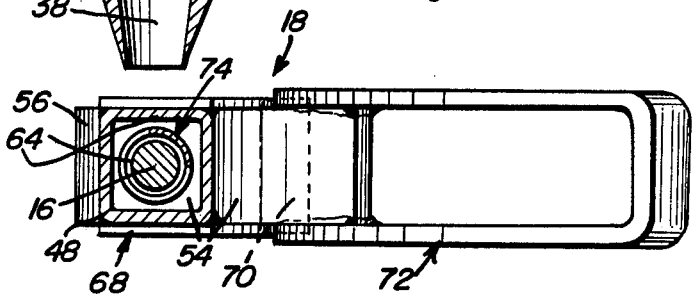
FIG. 3 is a sectional view taken generally along the line 3—3 of FIG. 2.

Referring now to FIGS. 2 and 3 of the drawings, longitudinal element 48 can be seen to be provided with a longitudinal socket 52 in which is disposed the shaft 16 of soil probe member 14 for sliding movement with respect to longitudinal element 48.

Clutch 18 includes a pressure element 54 having opposed generally planar surfaces 56 and 58 and mounted for rocking movement relative to shaft 16. Provided in element 54 is a through hole 60 receiving shaft 16 and having a diameter which decreases from surfaces 56 and 58 to a throat 62 substantially midway between the surfaces 56, 58. In this manner, hole 60 forms a pair of oppositely directed substantially coaxial frusto-conical shaft-engaging surfaces 64 and 66 joining at a transition zone. These surfaces 64, 66 cooperate to engage shaft 16 whenever the pressure element 54 is rocked to soil probe push-and-pull modes wherein a portion of each shaft-engaging surface contacts shaft 16. Further, surfaces 64, 66 release shaft 16 in a neutral mode of clutch 18 whenever surfaces 64, 66 contact the shaft substantially only at the transition zone joining surfaces 64 and 66. The "pull" mode is illustrated in FIG. 2 of the drawings, while it will be appreciated that the "push" mode would be the extreme opposite position of pressure element 54 and the neutral model will be in-between these two extreme positions.

Clutch 18 further includes a bracket 68 of substantial "U" configuration and provided with a cantilever. Bracket 68 is affixed on the other of the ends of the longitudinal element 48, and pressure element 54 is retained in bracket 68 by cantilever 70, with cantilever 70 forming a fulcrum for a rocking movement of pressure element 54 relative to shaft 16. In other words, the coaction of pressure element 54 with shaft 16 and cantilever 70 will limit movement of pressure element 54 relative to longitudinal element 48.

An extension 72 is provided on pressure element 54 for forming a footstep facilitating positioning of pressure element 54 during the neutral and push modes of clutch 18. As will be appreciated, only a slight foot pressure need be exerted on the extension 72 in order to hold pressure element 54 in the neutral position against the bias of a, for example, compression spring 74 disposed between longitudinal element 48 and pressure element 54 for biasing pressure element 54 toward the pull mode.

Preferably, bushings 76 and 78 are fitted within socket 52 for guidingly receiving shaft 16, and the one end of spring 74 is disposed abutting the lower bushing 78 in order to exert the desired bias against pressure element 54.

The operation of tool 10 will now be discussed in conjunction with FIGS. 4 through 9 of the drawings.

Tool 10 is first steadied in a nearly vertical position by grasping crossbar 50 with both hands, not shown. Sampling tube 20 is now forced into the soil S to be sampled by stepping firmly on the extension 72 as shown by the arrow in FIG. 4. Sampling tube 20 will be pushed into the soil to the depth indicated in broken lines in FIG. 4, and subsequently removed from the ground by pulling upward on crossbar 50. Sampling tube 20 is now emptied and cleaned and reinserted into the soil as shown in FIG. 5 until extension 72 is within, for example, an inch or two of surface S. Now, while maintaining a slight pressure on extension 72, pull upward on cross bar 50 until extension 72 has been elevated to, for example, six to eight inches above surface S. Continue to maintain a slight upward pressure on crossbar 50 and step downward on extension 72. The latter now grips shaft 16 and the sampling tube 20 can be pushed into the soil until extension 72 is within, for example, one or two inches of surface S. See FIG. 6.

Figures 7, 8, 9:
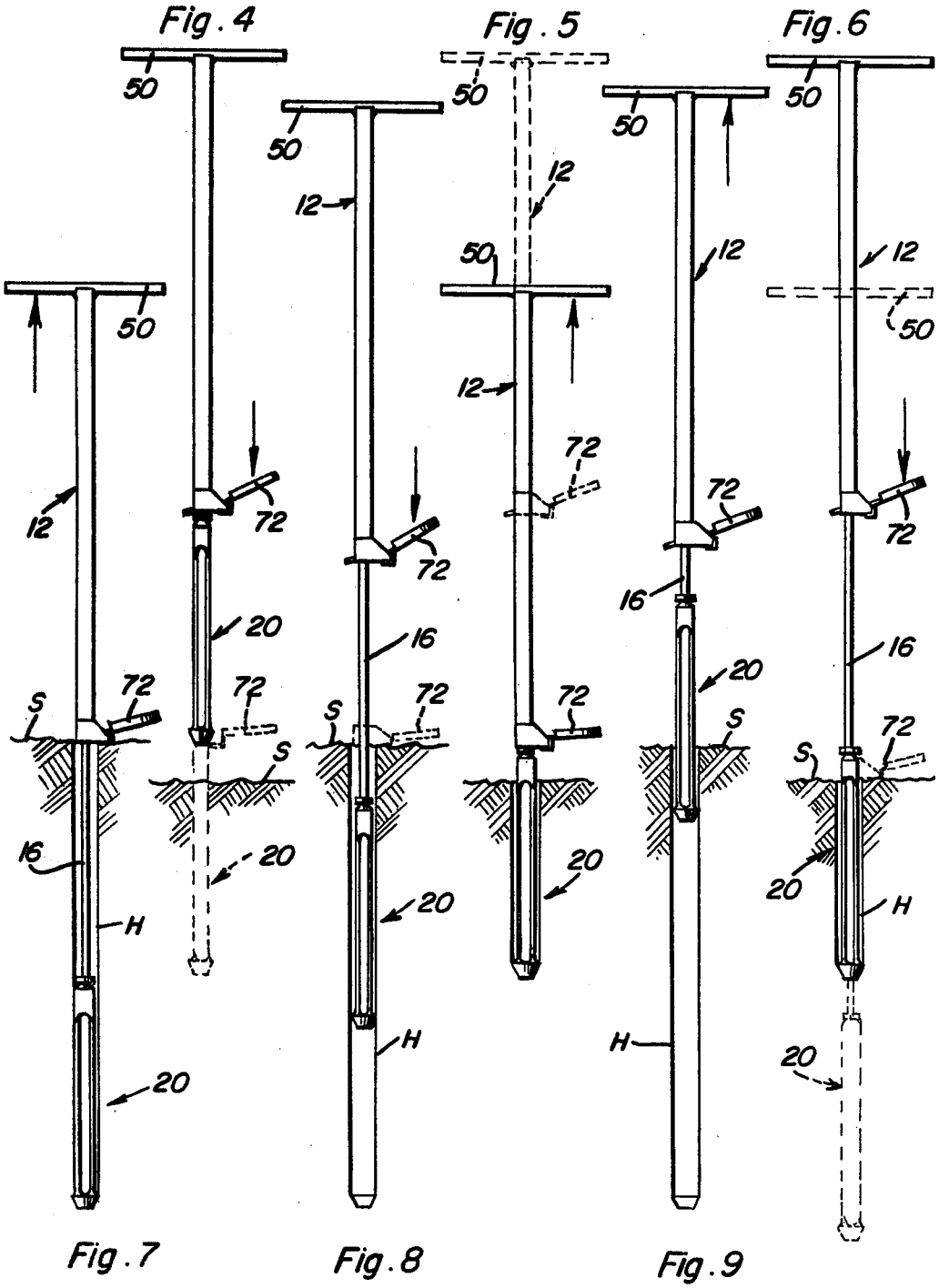

The steps set forth above as shown in FIGS.5 and 6 of the drawings are repeated, as shown in FIGS 7 and 8, until sampling tube 20 is full of soil being sampled. The depth of penetration of sampling tube 20 can be determined by the position of the end of shaft 16 which can be seen through the viewing holes 80 (FIG. 1) provided in the side of longitudinal element 48, which can be of the illustrated square cross secion. It is important not to push sampling tube 20 into the soil to a depth that exceeds its holding capacity as this jams the sample and can make removal from the ground extremely difficult.

Now remove the full sampling tube 20 by lifting upward on crossbar 50 as shown in FIG. 7. After the sampling tube has been elevated six to eight inches, for example, push downward on crossbar 50 returning extension 72 to within one or two inches of the surface S.

Sampling tube 20 can now be emptied and cleaned, and the abovedescribed steps as set forth in FIGS. 5 through 9 can be repeated until a desired depth of sample is reached.

Proper cleaning of sampling tube 20 ensures two things: (1) greatly reduced lifting pressures; and (2) a better soil core.

When cleaning sample tube 20, first clear trough 30 by inserting part 28 into the exposed sample and pulling part 28 along the length of trough 30. Second, remove the end plug from the sampling tube by placing part 36 over the end of the plug and pulling on the handle 24 of cleaner 22 in order to push the core from end 38 of tube 20.

Third, after sampling tube 20 is clear of soil, use part 40 as follows: apply a thin film of vegetable oil to the inside of the sampling tube 20 using a leg 42 of part 40, and use bight 44 of part 40 to apply a thin film to the outside of tube 20. Work a film of oil into the tip using one's fingers. The sponge, and the like, which is advantageously covered with a nylon or similar mesh, should be filled with vegetable oil each day. Vegetable oil is recommended because it is harmless to the skin and washes off easily with soap and water. Once every week or two, the sponge should be washed thoroughly using a liquid detergent.

As can be readily understood from the above description and from the drawings, a core extraction tool according to the present invention provides a simple yet efficient and safe mechanism for quickly and easily extracting accurate core samples.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A soil sample tube cleaning device, comprising a handle portion;

a cleaning head having a shaft which is connected to the handle portion;

said cleaning head having a trough cleaner which is mounted to the shaft portion of said cleaning head so as to be at substantially a right angle to the longitudinal axis of said handle, adapted for being pulled along the length of a soil sample holding trough of a soil sample tube, and an end core removal member arranged for removal of the end core of soil from the end of a sample tube by pulling on said handle portion.

2. The device of claim 1 wherein said end core removal member is mounted to said cleaning head so as to be in a generally parallel relationship to the longitudinal axis of said handle member.

3. The device of claim 1 wherein said cleaning head has a U-shaped part provided with absorbent material for applying a thin film of lubricant to the sample tube.

4. The device of claim 1 wherein said trough cleaner is a first disc shaped part which fits within said trough.

5. The device of claim 1 wherein said end core removal member is a second disc shaped part which fits within an open end of said sample tube.

6. The device of claim 1 which is adapted for removable mounting to a soil sample extraction tool.

* * * * *